United States Patent [19]

Reidt

[11] Patent Number: 4,505,034

[45] Date of Patent: Mar. 19, 1985

[54] LOCATING FIXTURE ASSEMBLY

[75] Inventor: Dean K. Reidt, Cottage Grove, Minn.

[73] Assignee: Minnesota Mining and Manufacturing Company, St. Paul, Minn.

[21] Appl. No.: 400,342

[22] Filed: Jul. 21, 1982

[51] Int. Cl.[3] ..... H01R 43/04

[52] U.S. Cl. ..... 29/749; 29/753; 29/759; 29/760

[58] Field of Search ..... 29/749, 751, 753, 759, 29/760, 861, 863

[56] References Cited

U.S. PATENT DOCUMENTS

| | | | |
|---|---|---|---|
| 4,020,540 | 5/1977 | Casciotti et al. | 29/749 |
| 4,077,695 | 3/1978 | Bakermans | 29/749 X |
| 4,194,276 | 3/1980 | Grubb | 29/749 X |
| 4,245,387 | 1/1981 | Reidt | 29/749 |
| 4,308,660 | 1/1982 | Brown et al. | 29/749 |
| 4,393,580 | 7/1983 | Hall, Jr. | 29/749 |

FOREIGN PATENT DOCUMENTS 0034433 2/1981 European Pat. Off. .

OTHER PUBLICATIONS

Cover page and p. 9 of a 3M catalog EL-SX-C-1(215)JR entitled "Source Book", first published Feb. 17, 1981.

Instruction sheets 34-7013-8620-2, first published Oct. 7, 1981, Particular attention is directed to the second page of this document.

*Primary Examiner*—Carl E. Hall

*Attorney, Agent, or Firm*—Donald M. Sell; James A. Smith; David W. Anderson

[57] ABSTRACT

A first embodiment of an assembly fixture for locating an electrical connector and a cable with respect to each other for assembly includes adjustable connector locating guides mounted on a base plate and adjustable cable guides mounted on a spring-loaded tiltable cable platform spaced above the base plate. As the cable is forced downwardly into the connector, the cable platform tilts to accommodate the relative motion of the cable with respect to the fixture. After the cable is assembled to the connector, the cable platform returns to its normal horizontal position, partially removing the connector from the connector locating guides. A second embodiment of an assembly fixture includes a connector support which has spaced lands which support the entire area of the connector to prevent breakage of the connector during assembly.

18 Claims, 7 Drawing Figures

LOCATING FIXTURE ASSEMBLY

BAKCGROUND OF THE INVENTION

1. Technical Field of the Invention

This invention relates to electrical conductors and connectors, and in particular, fixtures for locating flat, flexible cables and cable connectors with respect to one another for assembly.

2. Description of the Prior Art

Flat electrical cable with multiple conductors is most conveniently attached to other cables, electrical apparatus and printed circuit boards by means of a connector which commonly terminates each of the conductors comprising the cable and which may be assembled to a mating connector. A cable terminated in this manner may be easily connected and disconnected an indefinite number of times without confusion as to conductor order or damage to the conductors.

The cables may consist of individual insulated electrical conductors, but typically is a flat, flexible unitary structure which is made up of from 9 to 64 solid or stranded parallel conductors joined together and insulated from each other. Spacing between the individual conductors ranges from between 0.0425 inches (1.08 mm) and 0.075 inches (1.91 mm), with the most common spacing being 0.050 inches 81.27 mm). The conductors may be individually insulated and joined together by such means as adhesive bonding, ultrasonic welding or solvent welding, but usually the individual conductors are insulated and joined by a solid or multicolored coating which includes a reduced cross-section rib between the individual conductors. The ribbing allows the individual conductors to be easily separated from each other to produce branching circuits.

The connector typically comprises a plastic body which includes staggered rows of U-shaped contact elements spaced to correspond to the spacing of the cable conductors. Each contact element is formed with forked parallel legs which displace the conductor insulation as the conductor is forced into its slot. Deflection of these legs during termination results in a permanent grip on the conductor having spring compression reserve to maintain good electrical contact. A cover is usually provided to force the conductors into the contacts and maintain the conductors therein. The ends of the contacts opposite the conductor and the connector body may assume various shapes depending upon the apparatus to which the cable is to be connected, i.e., another cable, electrical equipment, bulkheads or circuit boards.

Assembly of the cable to the connector is typically accomplished by aligning the individual conductors comprising the cable with the proper contact in the connector body, placing a connector cover over the conductors and forcing the cover into assembled contact with the connector body in a press, thereby forcing the conductors into the contacts. In order to facilitate the alignment of conductors and contacts and insure that all connector parts and the cable remain in proper relationships during assembly, a fixture is usually used upon which the various components may be assembled and inserted into the press.

The fixture must maintain the components in proper relationship as the cable is aligned with the connector body and the cover is placed over the conductors and pressed into the connector body to force the individual conductors into their respective contacts and complete the cable to connector assembly. During assembly, the fixture must accommodate motion of the cable relative to the connector as the conductors are forced into their contacts and, ideally, the fixture should permit rapid placement of the components and easy removal of the assembly to permit high production levels. In addition, the fixture should be readily adjustable to accommodate cables and connectors having varying numbers of conductors and contacts, and must accommodate various configurations of the connector body.

SUMMARY OF THE INVENTION

The present invention provides a cable and connector assembly fixture which accommodates connectors and cables having varying numbers of contacts and conductors, retains the connector in proper relationship to the assembly press, aligns and maintains the cable relative to the connector, accommodates motion of the cable relative to the connector during assembly, aids in the removal of the cable/connector assembly from the fixture and accommodates various configurations of the connector body.

In one embodiment of a connector assembly fixture according to the present invention, there is included a ridged base plate and a raised, tilting cable platform. The base plate is provided with a slot extending transverse to the ridges to which is mounted two connector locating guides by means of spring-loaded pins. The locating guides may be moved toward or away from each other by separating the guides from the base plate against spring pressure and sliding the pins along the slot. The guides are angularly aligned with respect to the base by grooves on the undersides of the guides which mate with the base plate ridges. The guides are longitudinally aligned, with respect to the slot and each other, by a block which fits tightly within the slot and a transverse groove in the undersides of the guides to prevent relative movement between the guides and the edges of the slot. Each guide has two connector-receiving notches of different sizes which may be alternately presented to retain connector bodies of differing configurations by lifting and rotating the connector guides 180 degrees.

The cable platform is spring biased to a horizontal raised position and pivots around bearing pins to tilt toward the base plate. The platform includes ridges which extend parallel to the base plate ridges and which are spaced to engage every other cable rib and align the cable with respect to the connector. To position the cable in the proper ridges, there are provided two cable guide blocks which have grooved undersides which mate with the platform ridges. Like the connector locating guides, the blocks are retained by a spring-loaded pin extending through a slot in the platform and may be positioned correcting by separating the blocks from the platform against spring pressure and sliding the pin along the slot. The platform tilts in order to accommodate motion of the cable relative to the connector as a press forces the cable conductors into connector contact elements and the platform springs act to raise the cable and the attached connector from the connector locating guides after assembly of the cable to the connector and after the press pressure is relieved.

In a second embodiment of the invention, the base plate connector locating guides are replaced by a reversible connector locating and support block which simultaneously locates the connector body and supports the connector body against the forces created by the assembly press.

BRIEF DESCRIPTION OF THE DRAWINGS

The present invention will be more thoroughly described with reference to the accompanying drawings wherein like numbers refer to like parts in the several views, and wherein.

DETAILED DESCRIPTION OF THE INVENTION

Figure 1:
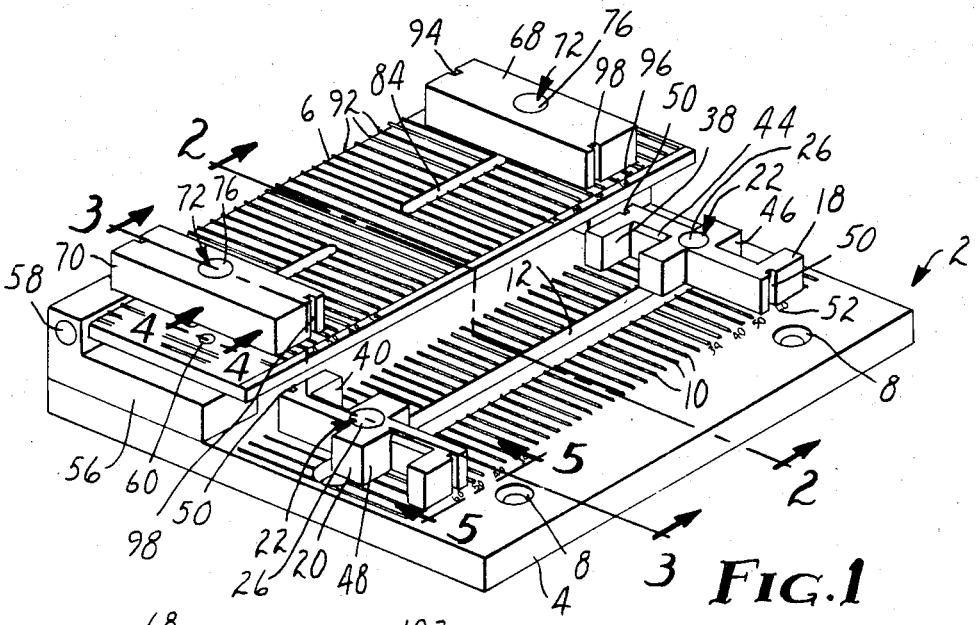
FIG. 1 is a perspective view of a first embodiment of a connector assembly fixture according to the present invention.

Referring now to the drawings, and in particular FIG. 1, there is shown a connector assembly fixture, generally indicated as 2, which includes a base plate 4 and a cable platform 6. The base plate 4 is square, has chamferred mounting holes 8 which permit the plate 4 to be mounted on a table or to an assembly press, and includes across its width pointed ridges 10 spaced at preferred interval of 0.100 inches (2.54 mm). Located midway along the length of the ridges 10 is a locating slot 12, best seen in FIG. 3, which extends transverse to the ridges 10 and is cut to a depth of approximately half the thickness of the plate 4. Cut at the bottom of the locating slot is a narrow locating pin slot 14 which is centered in the locating slot 12 and likewise extends transverse to the ridges 10. Cut into the underside of the base plate 4 is a relief slot 16 which is coaxial with the locating slot 12 and the pin slot 14 and which extends parallel to the slots 12 and 14 across the base plate 4.

Mounted on the ridges 10 are two connector locating guides 18 and 20 which are attached to the base plate 4 by means of locating pins 22 which extend through the locating slot 12, the locating pin slot 14 and terminate within the relief slot 16.

The locating guides 18 and 20 are counterbored to define locating pin recesses 24 which accommodate enlarged pin heads 26 and springs 28 disposed beneath the pin heads 26 and between the heads 26 and the bodies of the locating guides 18 and 20. The locating pins 22 are constrained against vertical movement by bearing washers 30 and snap rings 32 located within the relief slot 16 and, therefore, the springs 28 serve to bias the locating guides 18 and 20 into contact with the base plate 4.

Since the locating guides 18 and 20 are spring biased toward the base plate 4 rather than solidly attached, the locating guides 18 and 20 may be moved toward and away from each other along the locating slot 12 by lifting the locating guides 18 and 20 and sliding the locating pins 22 along the pin slot 14. The locating guides 18 and 20 are maintained in proper angular relationship to the base 4, i.e., parallel to the ridges 10, by means of grooves 34 cut in the underside of the locating guides 18 and 20 which mate with the base ridges 10. The locating guide grooves 34 are cut at 0.050 inch (1.27 mm) intervals which permits an incremental adjustment equal to this dimension. Since the spacing of the ridges 10 is twice that of the grooves 34, only alternate grooves 34 engage ridges 10 in any position of the locating guides 18 and 20.

To maintain the guides 18 and 20 in proper longitudinal relationship to the ridges 10, and to prevent skewing of the guides 18 and 20 with respect to each other, there are provided within the locating slot 12 square locating blocks 36 which are closely toleranced to the locating slot 12 and extend above the surface of the base 4 to engage transverse grooves 37 cut in the undersides of the guides 18 and 20. The blocks 36 are also closely toleranced to the transverse grooves 37 and thus prevent relative movement of the guides 18 and 20 with respect to the locating slot 12 in a direction parallel to the ridges 10.

Although the transverse locating guide grooves 37 are illustrated with square corners, the grooves 37 may assume any cross-sectional shape so long as the blocks 36 are correspondingly shaped to lock the guides 18 and 20 in position when seated on the base 4.

The locating guides 18 and 20 include inwardly facing notches 38 and 40 which accept a connector body 42 (shown in FIG. 2 in phantom lines) and maintain such connector body 42 in properly aligned relationship to the base plate 4. The notches 28 and 40 are beveled 44 adjacent the top surface of the locating guides 18 and 20 to facilitate insertion of the connector body 42.

The locating guides 18 and 20 also include alternate connector body locating notches 46 and 48 disposed opposite the locating pins 22 which are sized differently than the notches 38 and 40 to accept a connector body 42 having an alternate configuration, usually a different width. The alternate notches 46 and 48 may be put into use by lifting the locating guides 18 and 20 and rotating 180 degrees.

Finally, the locating guides 18 and 20 include viewing ports 50 located at the ends of the guides 18 and 20 through which a number legend 52 printed on the base plate 4 may be viewed. The printed numbers 52 indicate where the locating guides 18 and 20 are to be positioned to accommodate varying sizes of connector bodies 42.

Figure 2:
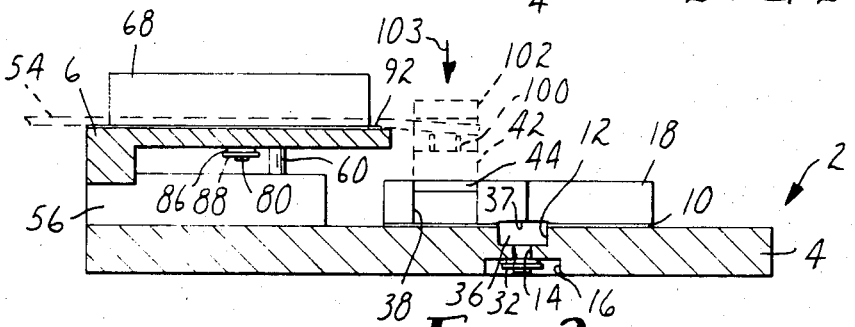
FIG. 2 is a sectional view of the fixture of FIG. 1 taken generally along the line 2—2 of FIG. 1 and illustrating a connector and a cable in phantom lines.
Figure 3:
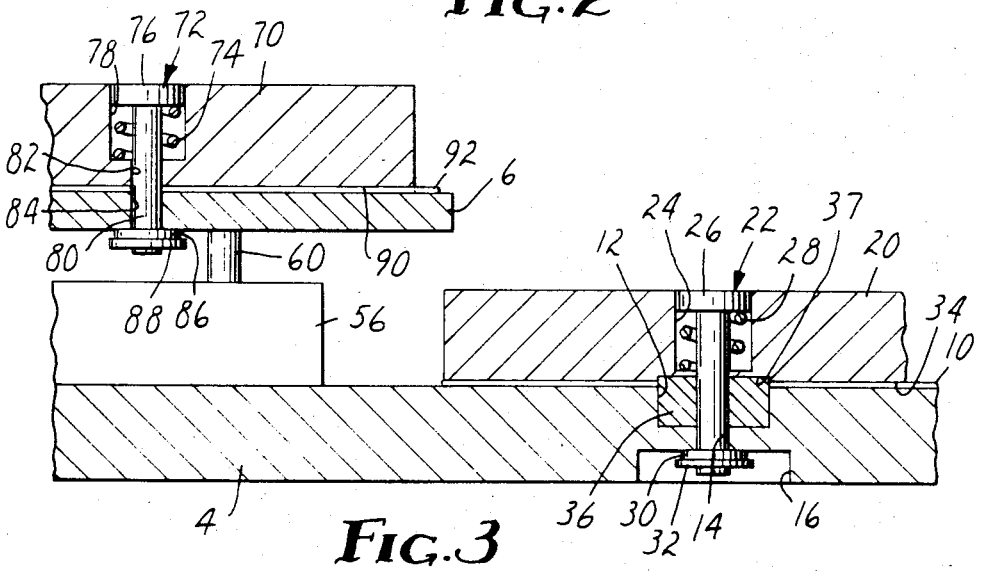
FIG. 3 is an enlarged, fragmentary sectional view taken generally along the line 3—3 of FIG. 1.
Figure 4:
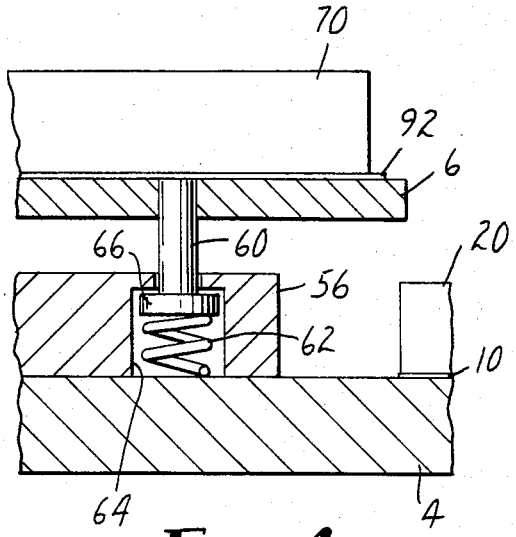
FIG. 4 is an enlarged, fragmentary sectional view taken generally along the line 4—4 of FIG. 1.
Figure 5:
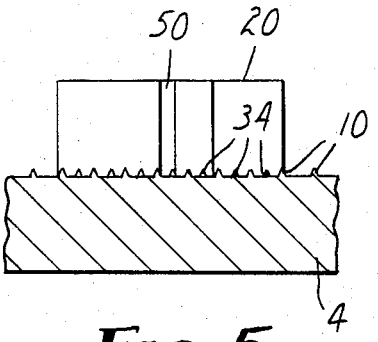
FIG. 5 is an enlarged, fragmentary sectional view taken generally along the line 5—5 of FIG. 1.

Turning now to the cable platform 6 which accommodates and supports a multi-conductor cable 54 which is to be attached to the connector body 42, there is shown in FIGS. 1–3 riser blocks 56 which are attached to the mounting plate 4 and support the cable platform 6 above the surface of the plate 4. The cable platform 6 is attached to the riser blocks 56 by bearing pins 58 which extend through the blocks 56 and into depressions (not shown) in edges of the cable platform 6. The cable platform 6 is maintained horizontal by support pins 60 which are biased away from the base 4 by springs 62 disposed within cylindrical recesses 64 formed in the riser block 56 and between enlarged heads 66 of the support pins 60 and the base plate 4. The support pins 60 are fixedly attached to the cable platform 6, as by press fitting, and the platform 6 and attached pins 60 may be pivoted around the bearing pins 58 by compressing the support pin springs 62.

Attached to the cable platform 6 are two cable guide blocks 68 and 70 which serve to locate the cable 54 with respect to the connector body 42. The cable guide blocks 68 and 70 are attached to the cable platform 6 by means of pin 72 and spring 74 arrangements similar to those which retain the connector locating guides 18 and 20 on the base plate 4. The pins 72 include enlarged heads 76 located in recesses 78 counterbored from the top surface of the cable guide blocks 68 and 70 and shafts 80 which extend through clearance holes 82 in the guide blocks 68 and 70 and through a slot 84 which extends across the cable platform 6 parallel to the locating slot 12 in the base plate 4. The pins 72 are retained with respect to the cable platform 6 by bearing washers 86 and snap rings 88. The springs 74 are disposed within the recesses 78 between the pin heads 76 and the body of the cable guide blocks 68 and 70 and bias the guide blocks 68 and 70 toward the cable platform 6. The guide blocks 68 and 70 may be moved in the direction of the slot 84 by lifting the blocks 68 and 70 against the biasing force of the springs 74 and sliding the pins 72 along the slot 84. The guide blocks 68 and 70 are held parallel to each other and perpendicular to the longitudinal axis of the connector body 42 by grooves 90 spaced at 0.050 inch (1.27 mm) intervals and located on the underside of the cable guide blocks 68 and 70 which mate with ridges 92 formed on the top surface of the cable platform 6 and spaced at 0.100 inch (2.54 mm) intervals. The ridges 92 not only insure proper alignment of the guide blocks 68 and 70 but also engage reduced cross-section ribs formed in the cable 54 between individual conductors.

The cable guide blocks 68 and 70 also include viewing ports 94 through which a numerical legend 96 printed on the cable platform 6 may be read. The legend 52 on the base plate 4 and the legend 96 on the cable platform 6 operate to coordinate the positions of the locating guides 18 and 20 and the cable guide blocks 68 and 70. Viewing ports 98 located on corresponding edges of the guide blocks 68 and 70 are offset toward the sides of the blocks 68 and 70 to provide additional clearance between the blocks 68 and 70 if the cable 54 is covered by a shield which increases the dimension of the cable from the last conductor on either side to the edges of the cable 54.

Referring to FIGS. 1 and 2, in operation, the connector locating guides 18 and 20 are rotated to present the appropriate notches 38 and 40 or 46 and 48 in opposed relationship to each other and moved along the locating slopt 12 until the legend 52 corresponding to the correct number of conductors to be connected may be viewed through the viewing ports 50 located on the locating guides 18 and 20. Similarly, the cable guide blocks 68 and 70 are located so that the appropriate viewing ports 94 or 98 are located adjacent the corresponding legend 96 on the cable platform 6. A connector body 42 is then inserted in the locating guide notches 38 and 40 or 46 and 48 and is held perpendicular to the ridges 10.

A multi-conductor cable 54 is inserted between the cable guide blocks 68 and 70 to overlie the connector body 42. The cable 54 is retained in a proper side-to-side relationship with the connector body 42 by the guide blocks 68 and 70 and the cable 54 is also engaged by the cable platform ridges 92 which insure that the individual conductors are properly located.

As stated above, the cable 54 is comprised of a number of individual parallel conductors which are encapsulated by insulation formed to produce ribs of a reduced cross-sectional area between the individual conductors. These individual conductors engage staggered rows of contacts 100 which are U-shaped with forked parallel legs which displace the conductor insulation as the conductor is forced into its slot.

After the cable 54 is properly aligned with the connector body 42, as described above, a connector cover 102 is placed over the cable 54 and aligned with the connector body 42. To form a completed assembly, the cover 102 is forced downward by an assembly press (not shown) in the direction of the arrow 103 of FIG. 2 and thereby attached to the connector body 42. The assembly press is conventional and may operate by mechanical, hydraulic or electrical means and may cease operation upon reaching a predetermined force or after closing to a predetermined shut-height.

In the process of securing the cover 102, the cable conductors are forced into the contacts 100 and electrical contact between the individual contacts and individual conductors is achieved. Since the cable 54 is forced downward toward the base plate 4, the cable platform 6 tilts to accommodate the movement of the cable 54. This tilting of the cable platform 56 is achieved by the bearing pins 58, around which the platform 6 may pivot, and the spring-loaded support pins 60 which resiliently bias the platform 6 to the horizontal position.

When the cable 54 and connector 42 assembly is accomplished, the support pins 60 return the cable platform 6 to the horizontal position as pressure on the connector cover 102 is relieved. This upward movement of the platform 6 lifts the connector 42 out of the connector locating guides 18 and 20 and thereby permits rapid removal of the assembly from the assembly fixture 2.

The connector assembly fixture 2 thus serves not only to align the various components of the cable/connector assembly, but also facilitates removal of the completed assembly from the fixture 2.

Figure 6:
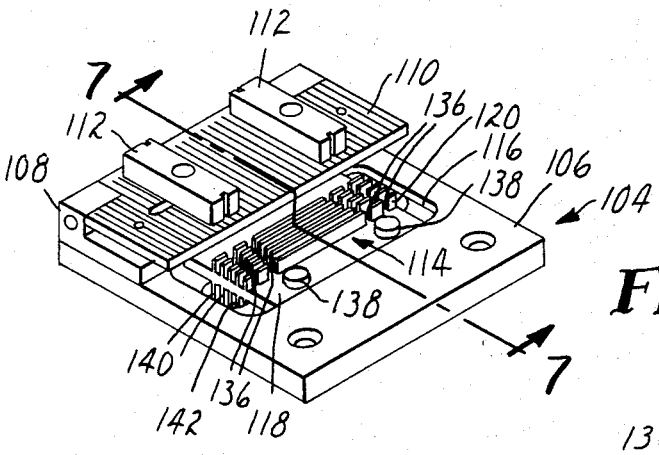
FIG. 6 is a perspective view of a second embodiment of a connector assembly fixture according to the present invention.
Figure 7:
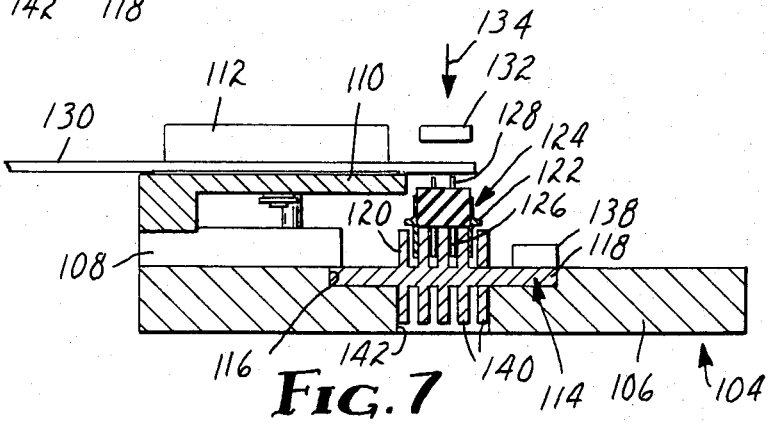
FIG. 7 is a sectional view of the fixture of FIG. 6 taken generally along the line 7—7 of FIG. 6.

Illustrated in FIG. 6 is a second embodiment of a connector assembly fixture 104 which is similar to the fixture 2 described above in that the portions of the assembly 2 above a base plate 106, i.e., riser blocks 108, a tiltable cable platform 110 and cable guide blocks 112, are identical to similar elements described above. The differences are that the base plate grooves 10 and locating guides 18 and 20 of FIGS. 1–5 are replaced by a connector locating and support block 114. The support block 114 fits within a recess 116 formed in the top surface of the base plate 106 and includes a support plate 118 from which project a number of spaced lands 120 which extend perpendicularly from the support plate 118 and across the width of the assembly fixture 104. The lands 120 are spaced from each other to accommodate a shell 122 of a connector 124 and the terminal ends 126 of staggered rows of contacts 128 molded into the body of the connector 124. The land 120 configuration is provided to support the entire area of the connector 124 in order to prevent breakage of the connector 124 as a cable 130 is forced into the contacts 128 by a connector cover 132 which is forced downwardly, as indicated by an arrow 134 in FIG. 7, by an assembly press (not shown). The contacts 128, connector 132 and assembly press operate as described above with respect to the assembly fixture 2 of FIGS. 1–5. The connector 124 is located along the length of the lands 120 by four grooves 136 which capture the ends of the connector 124 and prevent sidewards movement of the connector 124 along the lands 120.

The support plate 118 is attached to the base plate 106 by knurled screws 138 which extend through the plate 118 and into the base plate 106. The support plate 118 may be inverted on the base plate 106 and includes a second set of lands 140 which extend downwardly into a slot 142 formed in the base plate 106. The second set of lands 140 similarly support a connector but has grooves (not shown) which are spaced differently than the land grooves 136 to accommodate a connector having a different length than the connector 124 shown in FIG. 7.

The assembly fixture 104 also operates similarly to the assembly fixture 2 described above in that the connector body 124 and the cable 130 are positively aligned prior to and during assembly and in that the cable platform 110 facilitates removal of the completed assembly by lifting the connector 124 from the lands 120.

While the present invention has been described in connection with certain specific embodiments, it is to be understood that it is not to be limited to those embodiments. On the contrary, it is intended to cover all alternatives and modifications falling within the spirit and scope of the invention as set forth in the appended claims.

I claim:

1. A fixture for aligning flat electrical cable having a plurality of conductors and an electrical connector having a plurality of contacts corresponding to the number of conductors, comprising:

a flat base;

raised ridges on said base;

two locating guides including opposed connector-accepting notches and longitudinal grooves corresponding to and engaging said ridges to afford adjustable positioning of said guides with respect to each other on said base;

cable platform means for supporting said cable; and means for mounting said cable platform means in spaced relationship to said base and for permitting movement of said cable toward said base and into said connector.

2. A fixture according to claim 1 wherein said guides comprise means for resiliently biasing said guides toward said base.

3. A fixture according to claim 2 wherein said means for resiliently biasing said guides comprises a slot through said base extending between said guides, pins extending through said guides and into said slot, springs disposed between said pins and said guides and means for retaining said pins within said slot so that said guides may be separated from said base by compressing said springs and said guides may be adjusted relative to each other by sliding said pins along said slot.

4. A fixture according to claim 3 further comprising means for transversely positioning said guides with respect to said slot.

5. A fixture according to claim 4 wherein said means for transversely positioning comprises a transverse groove in each of said guides adjacent and substantially parallel to said slot and blocks extending between and closely engaging said slot and said transverse grooves.

6. A fixture according to claim 1 wherein said cable platform means comprises a plate and said means for mounting comprises means for pivotally mounting said plate parallel to said base and spaced above said connector guide means and means for resiliently maintaining said plate parallel to said base.

7. A fixture according to claim 1 wherein said cable platform means comprises a plate and said means for mounting comprises means for pivotally mounting said plate parallel to said base and spaced above said connector guide means and means for resiliently maintaining said plate parallel to said base.

8. A fixture according to claim 7 wherein said means for pivotally mounting said plate comprises a block attached to said base and a bearing spaced from said base and extending from said block toward and into said plate.

9. A fixture according to claim 8 wherein said means for resiliently retaining said plate comprises a pin fixed to said plate and extending toward said base and a spring disposed between said base and said pin, said pin being constrained from moving more than a predetermined distance from said base.

10. A fixture according to claim 6 wherein said means for resiliently maintaining said plate comprises a pin fixed to said plate and extending toward said base and a spring disposed between said base and said pin, said pin being constrained from moving more than a predetermined distance from said base.

11. A fixture according to claim 7 wherein said means for resiliently maintaining said plate comprises a pin fixed to said plate and extending toward said base and a spring disposed between said base and said pin, said pin being constrained from moving more than a predetermined distance from said base.

12. A fixture according to claim 6 wherein said means for pivotally mounting said plate comprises a block attached to said base and a bearing spaced from said base and extending from said block toward and into said plate.

13. A fixture according to claim 6 or 9 wherein said means for resiliently maintaining said plate comprises a pin fixed to said plate and extending towards said base and a spring disposed between said base and said pin, said pin being constrained from moving more than a predetermined distance from said base.

14. A fixture for aligning flat electrical cable having a plurality of conductors and an electrical connector having a plurality of contacts corresponding to the number of conductors, comprising:

a flat base;

connector guide means attached to said base for positioning said connector;

cable platform means for supporting said cable;

means for mounting said cable platform means in spaced relationship to said base and for permitting movement of said cable toward said base and into said connector;

raised ridges on said cable platform means; and two guide blocks including grooves corresponding to and engaging said ridges to afford adjustable positioning of said guide blocks with respect to each other on said cable platform means and alignment of said cable and said connector.

15. A fixture according to claim 14 wherein said guide blocks further comprise means for resiliently biasing said blocks toward said platform.

16. A fixture according to claim 15 wherein said means for resiliently biasing said blocks comprises a slot through said platform extending between said blocks, pins extending through said blocks and into said slot, springs disposed between said pins and said blocks and means for retaining said pins within said slot so that said blocks may be separated from said platform by compressing said springs and said blocks may be adjusted relative to each other by sliding said pins along said slot.

17. A fixture according to claim 14 wherein said connector guide means comprises a series of parallel lands extending substantially perpendicularly from said base to support said connector adjacent said contacts.

18. A fixture according to claim 17 further including grooves cut through said lands transverse to the lengths of said lands to engage said connector and locate said connector with respect to said lands.

* * * * *

UNITED STATES PATENT AND TRADEMARK OFFICE

CERTIFICATE OF CORRECTION

PATENT NO. : 4,505,034

DATED : March 19, 1985

INVENTOR(S) : DEAN K. REIDT

It is certified that error appears in the above-identified patent and that said Letters Patent is hereby corrected as shown below:

Column 1, line 4, "BAKCGROUND" should read -- BACKGROUND --.

Column 1, line 27, "81.27)" should read -- (1.27) --.

Column 2, line 56, "correcting" should read -- correctly --.

Column 3, line 36, "interval" should read -- intervals --.

Column 5, line 46, "slopt" should read -- slot --.

Claim 7, (column 7, line 61) "1" should read -- 14 --.

Claim 13, (column 8, line 26) "9" should read -- 12 --.

Signed and Sealed this

Twentieth Day of August 1985

[SEAL]

Attest:

DONALD J. QUIGG

Attesting Officer

Acting Commissioner of Patents and Trademarks